US006622893B2

(12) United States Patent
Leone et al.

(10) Patent No.: US 6,622,893 B2
(45) Date of Patent: Sep. 23, 2003

(54) VALVE GASKET FOR A METERING VALVE

(75) Inventors: Patrice Leone, Acquigny (FR); Sandrine Barranco, Saint-Sebastien-de-Morsent (FR); Patrick Di Giovanni, La Londe (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 10/095,456

(22) Filed: Mar. 13, 2002

(65) Prior Publication Data

US 2002/0190477 A1 Dec. 19, 2002

Related U.S. Application Data

(63) Continuation of application No. PCT/FR00/02518, filed on Sep. 12, 2000.

(30) Foreign Application Priority Data

Sep. 15, 1999 (FR) ..... 99 11502

(51) Int. Cl.[7] ..... B65D 83/00

(52) U.S. Cl. ..... 222/402.2; 222/402.24; 222/402.25

(58) Field of Search ..... 222/402.2, 402.24, 222/402.25; 277/637, 640, 644, 651

(56) References Cited

U.S. PATENT DOCUMENTS 2,585,286 A 2/1952 Tubbs
2,812,884 A * 11/1957 Ward ..... 222/402.2
3,109,625 A 11/1963 Steiman et al.
3,499,584 A * 3/1970 Warren ..... 222/402.2
3,866,804 A 2/1975 Stevens
4,165,083 A * 8/1979 Dochnahl ..... 277/642
4,191,389 A * 3/1980 Jelinek ..... 411/542
4,413,755 A * 11/1983 Brunet ..... 222/402.2
4,493,444 A * 1/1985 Del Bon et al. ..... 222/402.22
6,070,770 A * 6/2000 Tada et al. ..... 222/635

FOREIGN PATENT DOCUMENTS

FR 75 25168 3/1976
GB 2 000 232 A 1/1979

* cited by examiner

*Primary Examiner*—Joseph A. Kaufman
(74) *Attorney, Agent, or Firm*—Sughrue Mion, PLLC

(57) ABSTRACT

A valve gasket for a metering valve serving to dispense a fluid, in particular a powder dispersed in a propellant gas, the metering valve including a valve body defining a metering chamber, and a valve rod mounted to slide in the metering chamber between a rest position and an actuating position, the sealing between the valve rod and the metering chamber being provided by the valve gasket, the valve body being fixed in a fixing cap serving to assemble the valve onto a fluid reservoir, the valve gasket being provided with a radially inside contact zone over which the valve rod slides, the contact zone being fixed to a rigid element so that, while the valve rod is moving, the contact zone of the valve gasket remains substantially unchanging in terms of its shape and of its position, the contact zone having a profile that is rounded at least in part, so as to reduce the area of contact between the valve gasket and the valve rod, the rigid element being an integral part of the fixing cap, and in particular the inside radial edge thereof.

14 Claims, 3 Drawing Sheets

VALVE GASKET FOR A METERING VALVE

This is a Continuation of International Application PCT/FR00/02518, with an International filing date of Sep. 12, 2000, which was published under PCT Article 21(2) and the complete disclosure of which is incorporated into this application by reference.

The present invention relates to an improved valve gasket for a metering valve, and to a fluid dispenser device including a metering valve provided with such an improved valve gasket.

BACKGROUND OF THE INVENTION

Dispenser device valves are well known in the state of the art. They are mainly used with aerosol receptacles for dispensing fluids charged with propellant (dissolved gas under pressure). When the valve is a metering valve, it generally comprises a valve body enclosing a metering chamber defined axially by two annular gaskets, namely a valve gasket and a chamber gasket, and a valve rod mounted to move between a rest position and an actuating position. The valve rod is urged by a spring into its rest position, in which a shoulder on said rod bears against the bottom surface of said valve gasket. In order to actuate the metering valve, it is necessary to press on the valve rod which slides in the valve body inside the annular gaskets until it reaches its actuating position, in which a metered quantity of fluid is expelled. The spring then returns the valve rod to its rest position. Metering valves of this type are described in Documents EP-0 551 782, EP-0 350 376, FR-2 615 172, FR-2 615 173, and FR-2 615 124.

A problem that arises with the valve rods of valves, in particular of metering valves, concerns in particular leaktightness at the valve gasket. Firstly, it must be possible for the valve rod to slide between its actuating position and its rest position under the effect of the spring, while also preventing leaks from occurring. Secondly, when the valve rod is in the rest position, the leaktightness must be total in spite of the pressure inside the metering chamber and inside the receptacle.

To solve those problems, known valves generally have cylindrical valve rods such that, in alignment with said shoulder, and at least over the portion of the valve rod that slides in the valve gasket, the valve rod has a constant outside diameter that is approximately equal to (in general very slightly greater than) the inside diameter of the central opening in the valve gasket. To guarantee leaktightness in the rest position, a frustoconical portion is generally provided adjacent to said shoulder and extending axially over a portion of the thickness of said valve gasket. Thus, the valve rod slides in the valve gasket with friction, the force exerted by the spring being greater than said friction, and, in its rest position, the frustoconical portion adjacent to said shoulder participates in providing sealing at the valve gasket.

A drawback with such a configuration lies in the fact that the friction that appears while the valve rod is sliding can be relatively high, which can result in said valve rod sticking. In addition, the friction can deform the edge of the valve gasket that is in contact with the valve rod, so that the fluid can penetrate between said rod and said gasket. In particular, when the fluid is in the form of a powder, this can hinder or even prevent metering valve operation.

That phenomenon is further amplified when, in particular for ecological reasons, it is desired to replace propellant gases that are harmful to the environment, such as chlorofluorocarbons (CFCs), with propellant gases that are not harmful to the environment or that are less harmful to the environment, such as, for example hydrofluoroalkane (HFA) gases. Unfortunately, the use of such "environmentally-friendly" gases implies a major increase in the pressure inside the valve body, it being possible for such an increase to be as large as 50%. It is therefore necessary to provide even greater leaktightness at the valve gasket, which implies even higher friction between the valve rod and said gasket.

One possible solution to overcome that drawback is to provide a spring having sufficient stiffness. However, that requires a considerable amount of force to be exerted in order to actuate the metering valve, which is undesirable.

Another solution consists in coating the valve rod with a layer of silicone to improve its sliding qualities. That solution is relatively satisfactory with propellant gases such as CFCs, but it is not satisfactory when HFA gases are used. HFA gases expel the silicone during use of the valve, so that after it has been used a certain number of times, the problem of the valve rod sticking reappears.

OBJECTS AND SUMMARY OF THE INVENTION

An object of the invention is to provide a valve gasket for a metering valve that is designed to avoid undesired sticking of the valve rod due to friction between it and the valve gasket, while said valve rod is moving relative to the valve gasket, while also guaranteeing leaktightness at said valve gasket during this movement.

Another object of the invention is to provide a valve gasket that is designed to enable the valve rod to operate reliably and safely with a spring of low stiffness, thereby making it easier to actuate.

Yet another object of the invention is to provide a metering valve that operates with a propellant gas that is not harmful to the environment, said valve including a valve rod that can slide in the valve gasket between its actuating position and its rest position under the effect of the spring without leakage and without any risk of it sticking.

To these ends, the invention provides a valve gasket for a metering valve serving to dispense a fluid in the form of a powder dispersed in a propellant gas, said metering valve comprising a valve body defining a metering chamber, and a valve rod mounted to slide in said metering chamber between a rest position and an actuating position, the sealing between said valve rod and said metering chamber being provided by said valve gasket, said valve body being fixed in a fixing cap serving to assemble the valve onto a fluid reservoir, said valve gasket being provided with a radially inside contact zone over which said valve rod slides, said contact zone being fixed to a rigid element so that, while said valve rod is moving, said contact zone of the valve gasket remains substantially unchanging in terms of its shape and of its position, said contact zone having a profile that is rounded at least in part, so as to reduce the area of contact between said valve gasket and said valve rod, said rigid element being an integral part of said fixing cap, and in particular the inside radial edge thereof. Thus, for given dimensions of the valve rod, said rod slides with lower friction, thereby avoiding sticking of the valve rod, while also guaranteeing excellent leaktightness.

The use of such a valve gasket thus makes it possible to avoid any deformation of the valve gasket, thereby preventing any fluid from being trapped between the rod and the gasket.

Advantageously, said valve gasket is fixed, in particular snap-fastened, to the inside radial edge of said fixing cap.

In a variant, said valve gasket is molded directly over said inside radial edge of said fixing cap.

The present invention also provides a metering valve including such a valve gasket, and it also provides a fluid dispenser device including such a metering valve.

BRIEF DESCRIPTION OF THE DRAWINGS

Other characteristics appear from the following detailed description of the invention, given by way of non-limiting example, and with reference to the accompanying drawings, in which.

MORE DETAILED DESCRIPTION

Figure 1:
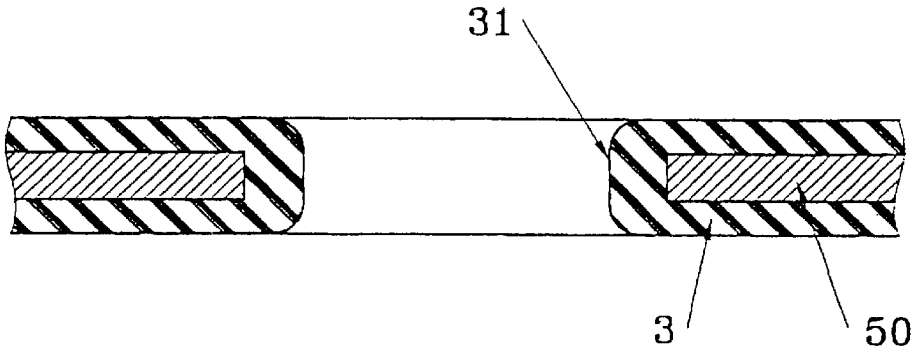
FIG. 1 is a diagrammatic section view of a valve gasket.

The invention is described below with reference to an example of a metering valve as shown in the drawings, but clearly it is applicable to metering valves of all types.

Figure 3:
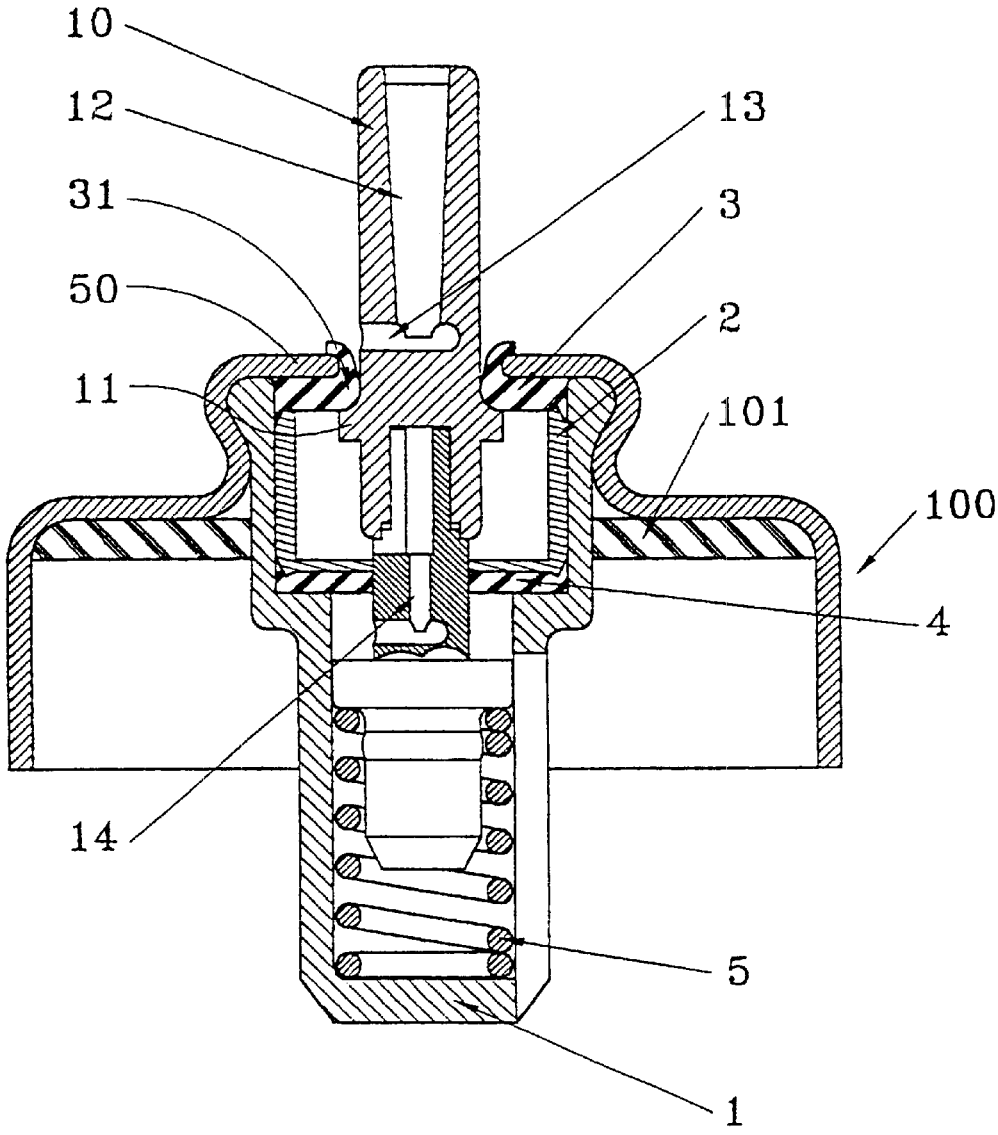
FIG. 3 is a diagrammatic section view of an advantageous embodiment of a metering valve of the present invention, incorporating the valve gasket of FIG. 2, with the valve rod being shown in its rest position.
Figure 4:
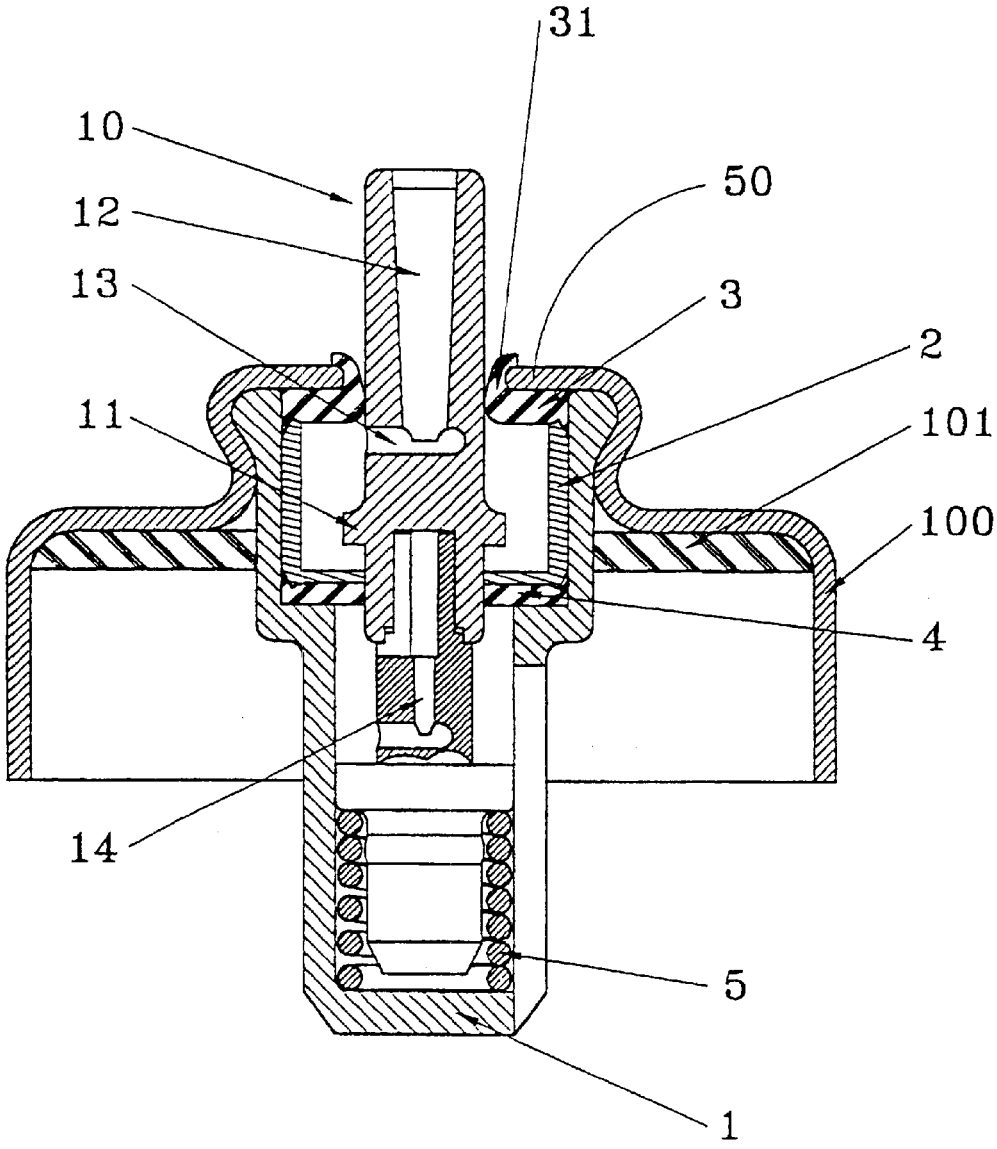
FIG. 4 is a view similar to the FIG. 3 view, with the valve rod being shown in its actuating position.

With reference to FIGS. 3 and 4, a metering valve may include a valve body 1 enclosing a metering chamber 2. The metering chamber 2 may be defined axially by two annular gaskets, namely a valve gasket 3 and a chamber gasket 4. Each of the two gaskets may be provided with a central opening through which a valve rod 10 passes. The valve rod is mounted to move inside the valve body 1 between a rest position shown in FIG. 3 and an actuating position shown in FIG. 4. The valve rod 10 may be urged into its rest position by a resilient member such as a spring 5 that abuts at one end against the bottom of the valve body 1, and at its other end against the bottom end of the valve rod.

The valve body 1 may be fixed, e.g. crimped, in a cap 100 which is then fixed, e.g. by crimping, to the neck of a receptacle or flask of any type (not shown). Advantageously, a neck gasket 101 is provided between said cap 100 and said neck of the receptacle.

The valve rod 10 is generally provided with a dispensing channel 12 opening out via a radial hole 13 onto its outside surface. When the valve rod is in the rest position, said radial hole 13 opens out to the outside of the valve gasket 3, whereas, when it is in said actuating position, it opens out inside the metering chamber 2.

The valve rod 10 may further be provided with a radial shoulder 11 which abuts against the bottom surface of the valve gasket 3 when the valve rod 10 is in the rest position, and which thus defines said rest position by acting as an abutment member opposing the thrust from the spring 5.

The valve rod 10 is advantageously also provided with a duct 14 which, when the valve rod is in the rest position, connects a fluid reservoir or receptacle (not shown) to the metering chamber 2, so as to enable the metering chamber to be filled, whereas, when the valve rod is in the actuating position, it does not open out into the metering chamber 2.

The metering valve operates conventionally. The user exerts a pressure on the valve rod 10, there by causing it move against the force of the spring 5 away from its rest position. As soon as the valve rod starts moving, the duct 14 no longer opens out into the metering chamber 2, and said metering chamber is then hermetically closed by the valve rod 10 at the chamber gasket 4 and at the valve gasket 3. When the valve rod 10 reaches its actuating position, the radial hole 13 in the valve rod opens out into the metering chamber 2, thereby enabling the metered quantity of fluid contained in said metering chamber to be dispensed via the dispensing channel 12. The user then releases the pressure on the valve rod 10, which is returned by the spring 5 to its rest position, in which the duct 14 opens out in the metering chamber 2, so that said metering chamber is filled with a metered quantity of fluid once again.

The valve gasket 3 is provided with a radially inside contact zone 31 against which the valve rod 10 is slidably received in leaktight manner. In the invention, this contact zone 31 is fixed to a rigid element 50 so as substantially to prevent any displacement and/or deformation of said contact zone 31 while the valve rod 10 is moving.

With reference to FIG. 1, said rigid element 50 is a rigid insert disposed inside said valve gasket 3. Thus the flexible portion of the gasket that forms the contact zone 31 is retained axially by the rigid insert while the valve rod 10 is moving, thereby preventing any of the fluid from penetrating between these two elements. The rigid insert 50 may, for example, be made of stainless steel, the gasket being injection molded around said element.

Figure 2:
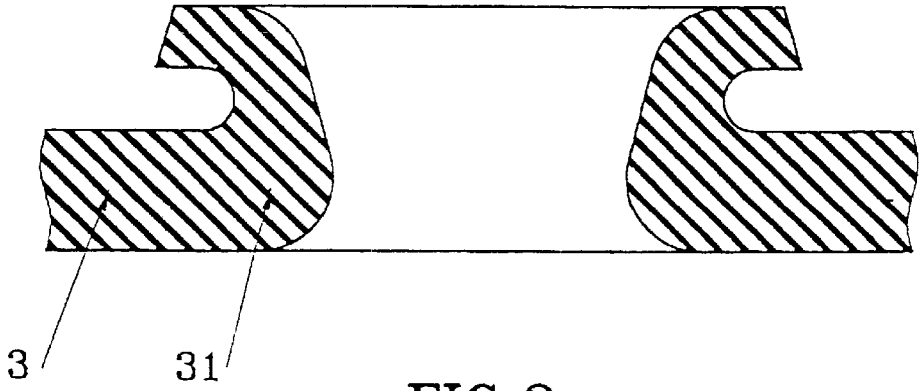
FIG. 2 is a diagrammatic section view of an embodiment of a valve gasket of the invention.

In an embodiment of the present invention, shown in FIGS. 2 to 4, said rigid element is an integral part of or is secured to the fixing cap 100. In particular, the valve gasket 3 is fixed around the inside radial edge 50 of said cap. The contact zone 31 of the gasket 3 is retained axially by said radial edge of the cap. The gasket 3 may be injection molded to a shape such as the shape shown in FIG. 2, and then fixed to the cap 100, e.g. by crimping, or else the gasket 3 may be molded directly over the cap 100.

Advantageously, the contact zone 31 of the valve gasket 3 may further have a shape that is rounded at least in part, so as to reduce the area of contact between the gasket and the valve rod, and thus to reduce friction. Such a rounded shape also prevents any trapping of the fluid at the ends of said contact zone 31.

Since the valve rod 10 slides better over the sealing gasket, its outside dimensions can thus be organized so that it co-operates with the gasket to guarantee excellent leaktightness, even when environmentally-friendly gases such as HFAs are used, while also guaranteeing excellent sliding through the central opening in said gasket, thereby avoiding problems of the rod sticking.

Since the stiffness of the spring 5 must be directly proportional to the friction forces exerted by the valve gasket 3, the invention thus makes it possible to use a spring of lower stiffness. The metering valve of the invention is thus easier to actuate in that the force necessary to actuate it is reduced.

Another advantage of the valve gasket of the invention is that, since the friction forces exerted by the valve gasket 3 on the valve rod 10 are reduced while said rod is returning to its rest position, the speed of movement of the valve rod is higher, thereby increasing the reliability of the valve.

The invention thus guarantees that the metering valve operates reliably, and that leaktightness is total at the valve gasket, and it therefore makes it possible, in particular, to use gases that are not harmful to the environment, such as HFA gases, in spite of the major increase in the pressure inside the metering chamber. In addition, it is possible to use a spring of lower stiffness, thereby making it easier to actuate the metering valve.

The invention is described above with reference to the figures which show a metering valve the "right way up", but naturally it also applies to metering valves that operate upside down.

What is claimed is:

1. A valve gasket assembly configured for a metering valve serving to dispense a fluid, the metering valve having a valve body defining a metering chamber, and a valve rod mounted to slide in the metering chamber between a rest position and an actuating position, said valve gasket assembly comprising:

a fixing cap configured to secure the valve body and to assemble the valve onto a fluid reservoir; and a valve gasket configured to provide sealing between the valve rod and the metering chamber, said valve gasket provided with a radially inside contact zone configured to receive the valve rod in sliding contact, said contact zone being fixed to a rigid element so that, when the valve rod moves, said contact zone of said valve gasket remains substantially unchanging in terms of its shape and of its position, said contact zone having a profile that is rounded at least in part, so as to reduce the area configured to contact the valve rod, and wherein said rigid element is an integral part of said fixing cap.

2. The valve gasket assembly according to claim 1, in which said valve gasket is fixed to an inside radial edge of said fixing cap.

3. The valve gasket assembly according to claim 2, wherein said valve gasket is snap-fastened to the inside radial edge of said fixing cap.

4. The valve gasket assembly according to claim 1, wherein said rigid element is an integral part of an inside radial edge of said fixing cap.

5. The valve gasket assembly according to claim 1, where the fluid is a powder dispersed in a propellant gas.

6. The valve gasket assembly according to claim 1, in which said valve gasket is molded directly over an inside radial edge of said fixing cap.

7. A metering valve assembly for dispensing a fluid, comprising:

a valve body defining a metering chamber;

a valve rod mounted to slide in said metering chamber between a rest position and an actuating position;

a fixing cap that secures said valve body and is configured to assemble said valve assembly onto a fluid reservoir; and a valve gasket that provides sealing between said valve rod and said metering chamber, said valve gasket comprising a radially inside contact zone over which said valve rod is in sliding contact, said contact zone being fixed to a rigid element so that when the valve rod moves, said contact zone of said valve gasket remains substantially unchanging in terms of its shape and of its position, said contact zone having a profile that is rounded at least in part, so as to reduce an area of siding contact between said valve gasket and said valve rod.

8. A dispenser device for dispensing a fluid said dispenser device including a metering valve according to claim 7.

9. The dispenser according to claim 8, further comprising a powder dispersed in a propellant gas.

10. The dispenser according to claim 8, further comprising a pharmaceutical.

11. The metering valve according to claim 7, wherein said rigid element is an integral part of said fixing cap.

12. The metering valve according to claim 11, wherein said rigid element is an integral part of an inside radial edge of said fixing cap.

13. The metering valve according to claim 7, wherein said valve gasket is molded directly over an inside radial edge of said fixing cap.

14. The metering valve according to claim 7, wherein said valve gasket overlaps said rigid element on at least two opposing sides of said rigid element.

* * * * *